United States Patent [19]

Pavel

[11] 4,116,333

[45] Sep. 26, 1978

[54] DISPENSER FOR SEWING MACHINE NEEDLES OR THE LIKE

[75] Inventor: Klaus Pavel, Eynatten, Belgium

[73] Assignee: Rhein-Nadel Maschinennadel GmbH, Aachen, Fed. Rep. of Germany

[21] Appl. No.: 821,776

[22] Filed: Aug. 4, 1977

[30] Foreign Application Priority Data

Apr. 5, 1977 [DE] Fed. Rep. of Germany ..... 2715192

[51] Int. Cl.[2] ..... B65D 85/24

[52] U.S. Cl. ..... 206/380; 223/109 R; 312/73

[58] Field of Search ..... 206/380, 382, 383; 223/109 R, 99, 106; 312/73

[56] References Cited

U.S. PATENT DOCUMENTS

| | | | |
|---|---|---|---|
| 2,042,403 | 5/1936 | Hrivnak | 223/99 |
| 2,573,311 | 10/1951 | Cupler | 312/73 |
| 2,771,990 | 11/1956 | Buschkamper | 312/73 |
| 2,782,917 | 2/1957 | Kruft | 312/73 |
| 3,080,964 | 3/1963 | Robinson et al. | 206/303 |

FOREIGN PATENT DOCUMENTS

| | | | |
|---|---|---|---|
| 721,527 | 1/1955 | United Kingdom | 206/380 |

*Primary Examiner*—William T. Dixson, Jr.
*Attorney, Agent, or Firm*—Martin A. Farber

[57] ABSTRACT

A dispenser for sewing machine needles or the like comprising an upper part and a lower part. The lower part formed circularly is provided with reception shafts for sewing needles, which reception shafts are arranged secant-like. The upper part is mounted rotatably on the lower part. The upper part has an edge closing the front-sided push-in cross-section of the reception shafts, the edge being formed with a removal opening rotatable respectively in front of the push-in cross-section of the shafts.

16 Claims, 6 Drawing Figures

DISPENSER FOR SEWING MACHINE NEEDLES OR THE LIKE

The invention relates to a dispenser for sewing machine needles or the like comprising an upper part and a lower part.

The subject matter of the invention is based on the task, particularly, that is additionally to those objects which may be gathered from the specification and claims, to provide a dispenser of the previously mentioned generic type of advantageous utility in an economically simpler way, such that with a neat grouping arrangement of the sewing machine needles in the dispenser respectively the desired sewing machine needle can be brought into the release position with easier handling.

It is another object of the present invention, to aid the solution of the above-mentioned object, in the manner that the lower part 1 formed as a circular disc is provided with reception shafts 2 for the sewing needles 4, which reception shafts are arranged secant-like, and an upper part 11 mounted rotatably thereon, the edge 10 of the upper part closing the front-sided push-in cross-section of the shafts 2, the edge 10 being formed with a removal opening 17 rotatable respectively in front of the push-in cross-section of the shafts 2.

As a result of such formation in accordance with the present invention a dispenser for sewing machine needles or the like is provided which is characterised by a high utility value. The sewing machine needles lie well arranged adjacent one another in secant-formed alignment in the reception shafts of the lower part and are covered by the upper part. The sewing machine needles are secured against falling out by the edge of the upper part. If a desired sewing machine needle is to be removed, the upper part, which is mounted rotatably on the lower part is to be turned such that the removal opening 17 of the edge lies flush with the corresponding push-in cross-section. In the manner that the dispenser is held such that the push-in cross-section and removal opening point downwardly, the sewing machine needle can slide out from its reception shaft. For the other sewing machine needles this is not possible,, since their push-in cross-sections are closed by the edge 10 of the upper part. As a result of a circular shape of the lower part and upper part, simple geometrical forms are present, which permit economical production of the dispenser. Furthermore the dispenser can be assembled or erected in a space conservation manner, so that also the possibility of a good stacking of the same is provided. The number of reception shafts in the lower part is variable. For example there can be 10, 5 or also 3 needles provided per dispenser. After the use of a needle, the latter can again be returned into the dispenser, in the manner that the corresponding push-in opening is freed by rotating the upper part.

An advantageous feature according to the invention resides in that the rotatable upper part carries a scale which lies concentric to the center point of rotation and the lower part carries a corresponding scale line or mark. The scale indicates the needle gauge. By means of positioning the corresponding needle gauges and scale line above one another, the removal opening lies in front of the selected push-in cross-section of the corresponding reception shaft.

The handling is facilitated in the manner that the scale mark is formed as a luminous color field.

Beyond that it has proven favorable to make the rotatable upper part of a transparent material and the lower part of a dark or black colored material. The blank sewing machine needles can be recognized very well as a result of the prominent contrast. If the dispenser is not filled, this can be noticed from the outside.

The fixing of the upper part relative to the lower part in the corresponding rotation positions can be achieved in the manner that the cover is catch lockable in its different rotation positions.

There exists an advantageous feature in the manner that the lower part is formed with catch notches in the range of a partial section of its edge, which catch notches lie one behind the other, and the rotatable upper part forms a catch tooth in the range of its edge, which catch tooth is coordinated in the catch notches. The catch locking thereby is placed on the edge of the dispenser so that a favorable lever arm exists and good feelable or sensible catch locking positions are able to be achieved.

From a point of view of manufacturing advantages are brought about in that the catch tooth is formed as free-cut section of the edge collar of the upper part, the edge collar engaging on the circumferential edge of the lower part. For the catch engagement, consequently, no additional construction parts are required. The catch action results from the characteristic or self elasticity of the material of the cover upper part, which preferably is made of a corresponding transparent synthetic or plastic material.

Further advantages of use are provided in the manner that the edge of the lower part is designed step-like in the range laterally of the shafts and gripping zones are formed, which gripping zones project above the edge collar of the upper part. Thereby it can not occur that the hand holding the lower part closes the push-in cross-sections. The projecting gripping-zones further brings about the effect that the finger which engages on the lower part does not impair the rotation of the upper part.

Furthermore it has proved advantageous in accordance with the present invention that the upper part in its rotation end positions steps against an abutment shoulder blocking the further rotation movement. In one of the rotation end positions altogether all reception shafts are closed. The other rotation end position is chosen such that the removal opening of the upper part is aligned flush with the push-in cross-section of the last reception shaft.

A further function of the needle dispenser is realised in that at least one upper part section lying laterally of the outer shaft has a lens or lenticularly shaped partial section above a break-through opening or interruption in the lower part. On the one hand it is in this manner possible to use the dispenser as a magnifying glass, for example during the threading of the thread. On the other hand the magnifying glass by turning of the upper part can be brought over the needle pistons.

Also there exists the possibility that the step-shaped set-off rear surface of the lower part of the needle tool can be releasably fastened, preferably in a clamping seat under two holding clips or tongues. The capability of stacking the dispensers in this manner is not limited, since the threading tool can be coordinated to the dispensers in a space conservation manner and without being able to come loose and be lost.

A secure holding of the sewing machine needles in the reception shafts is provided in the manner that the shafts are covered in the center range by a rib. This rib extends in the vicinity of the transition or transfer point between the piston and the shaft of the sewing machine needles.

Molding technique advantages are also brought about in the manner that the rear surface of the bottom has penetration openings in the range under the rib.

Furthermore it is yet of advantage that the edge collar of the upper part is interrupted by uniformly distributed cuts. The upper part is consequently able to be clipped on with its edge collar on the circumferential edge of the lower part. For guiding of the upper part there serves subsequently the circumferential edge of the lower part, so that no additional construction parts are required for mounting the upper part.

With the above and other objects and advantages in view, the present invention will become more clearly understood in connection with the following detailed description of a preferred embodiment, when considered with the accompanying drawings, of which:

Figure 4:
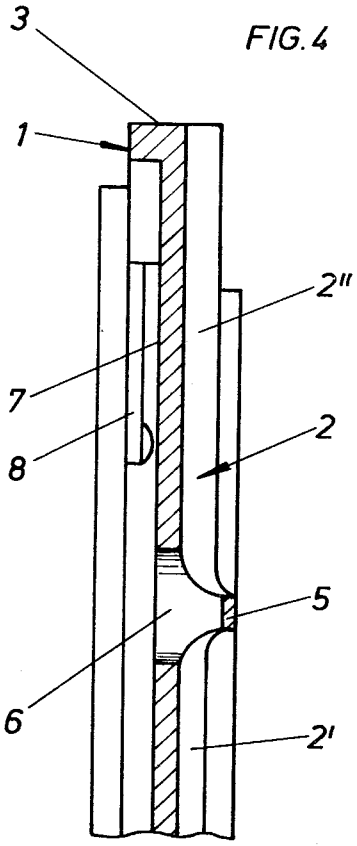
FIG. 4 is a longitudinal section through the lower part in the range of a reception shaft.

Referring now to the drawings, the dispenser in accordance with the present invention has a lower part 1 formed as a circular disc. The lower part is provided in its center section with ten secant-like aligned reception shafts 2. Each reception shaft 2 comprises a cross-sectionally smaller section 2' and a cross-sectionally larger section 2'', the latter being open at the circumferential edge 3 of the lower part and forms a push-in insertion cross-section for the sewing machine needles 4. The two sections 2' and 2'' are separated from one another by an arcuately extending rib 5 (FIG. 4).

The piston 4' of the sewing machine needle is inserted in the cross-sectionally larger section 2'', while the cross-sectionally smaller section 2' receives the shank 4'' of the sewing machine needle. Preferably the bottom surface F of the cross-sectionally larger section 2'' of the reception shaft 2 is constructed even or planar. The flattened section of the piston 4' of the sewing machine needles steps against this bottom surface F, so that the needles are non-rotatable in the reception shafts 2.

Figure 6:
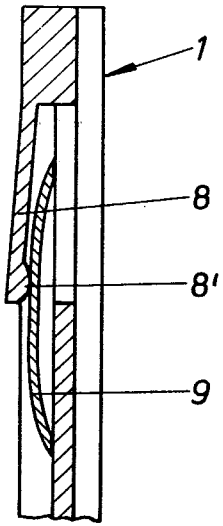
FIG. 6 is a longitudinal section through the lower part in the range of a holding clip fixing the threading tool.

The rear surface 7 of the lower part 1 has longitudinal hole-like penetration openings 6 which from molding technical grounds are in the range of the lower half of the rib 5. This rear surface 7 is set-off step-like. Two parallel holding clips or tongues 8 which are disposed adjacent one another extend from the rear surface 7, the holding clips 8 having clamping projections 8' (FIG. 6), the latter bracing a threading tool 9 against the rear surface 7.

Figure 3:
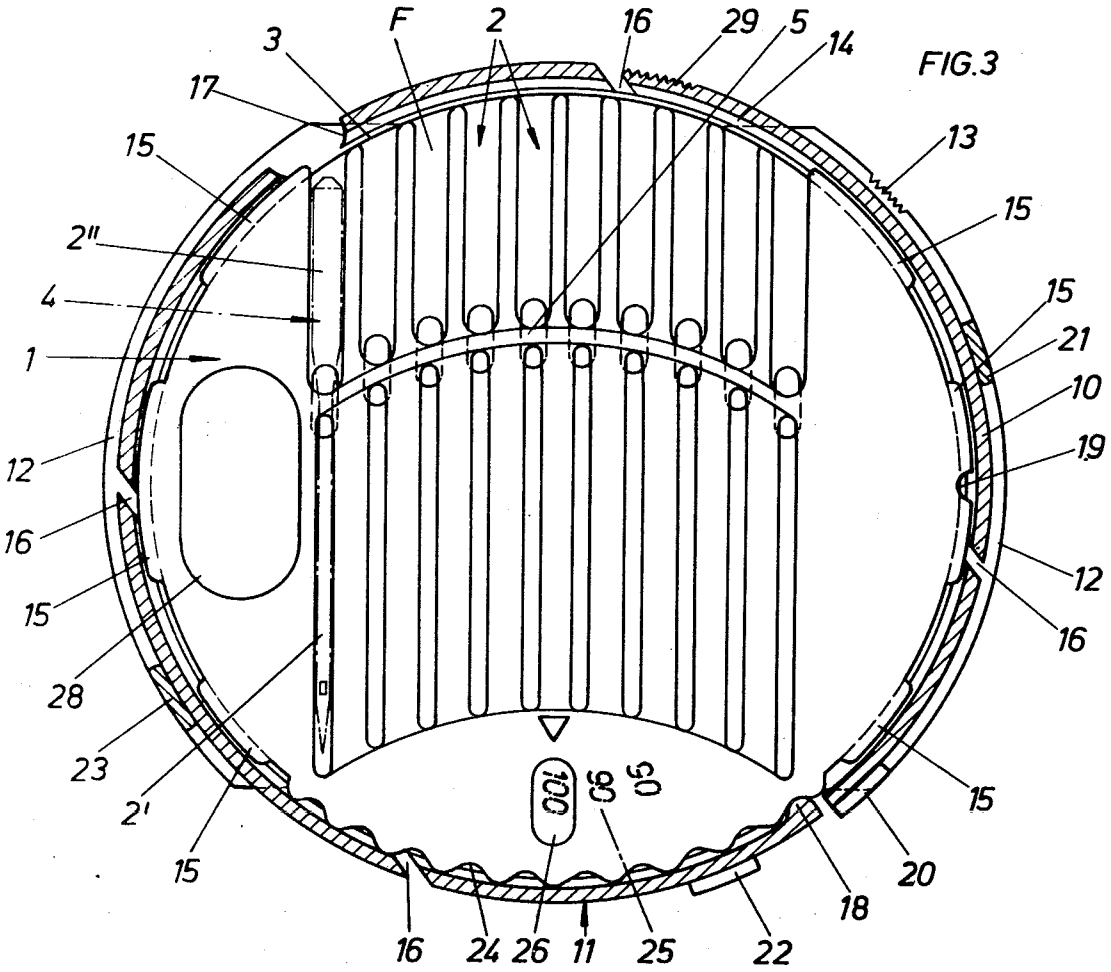
FIG. 3 is a plan view of the lower part with sectioned upper part.
Figure 5:
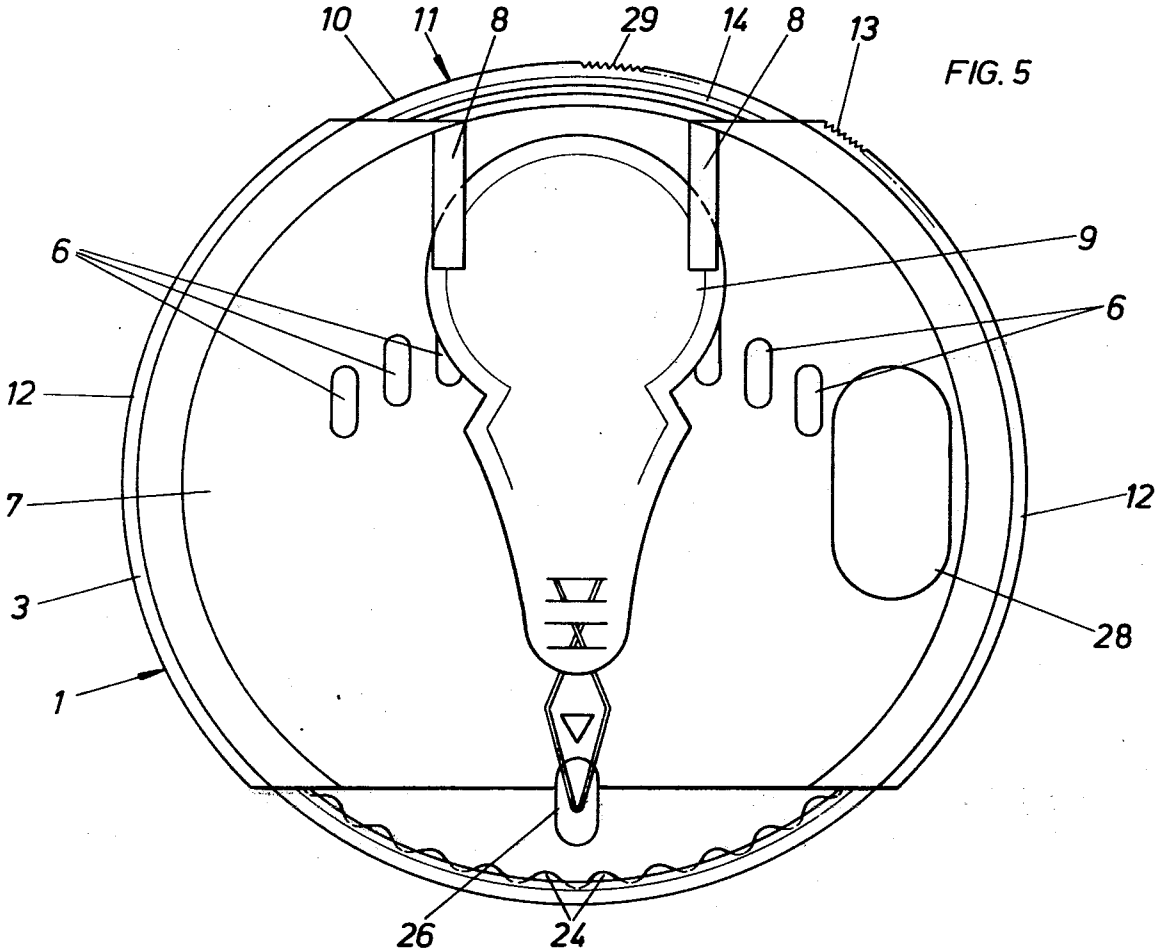
FIG. 5 is a rear view of the dispenser.

The lower part 1, made of a black colored material, is designed step-shaped in a range laterally of the shafts 2, and forms gripping zones 12 projecting over the edge collars 10 of the upper part 11. The gripping zones 12, as illustrated in FIGS. 3 and 5, are provided with a knurling or serration 13.

Figure 2:
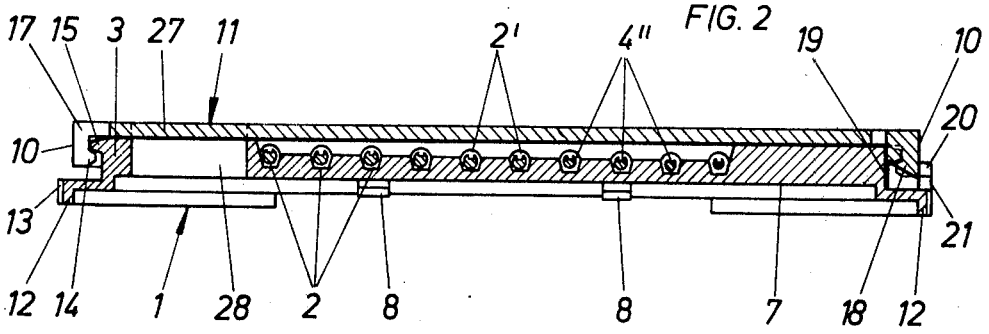
FIG. 2 is a cross-section through the dispenser.
Figure 1:
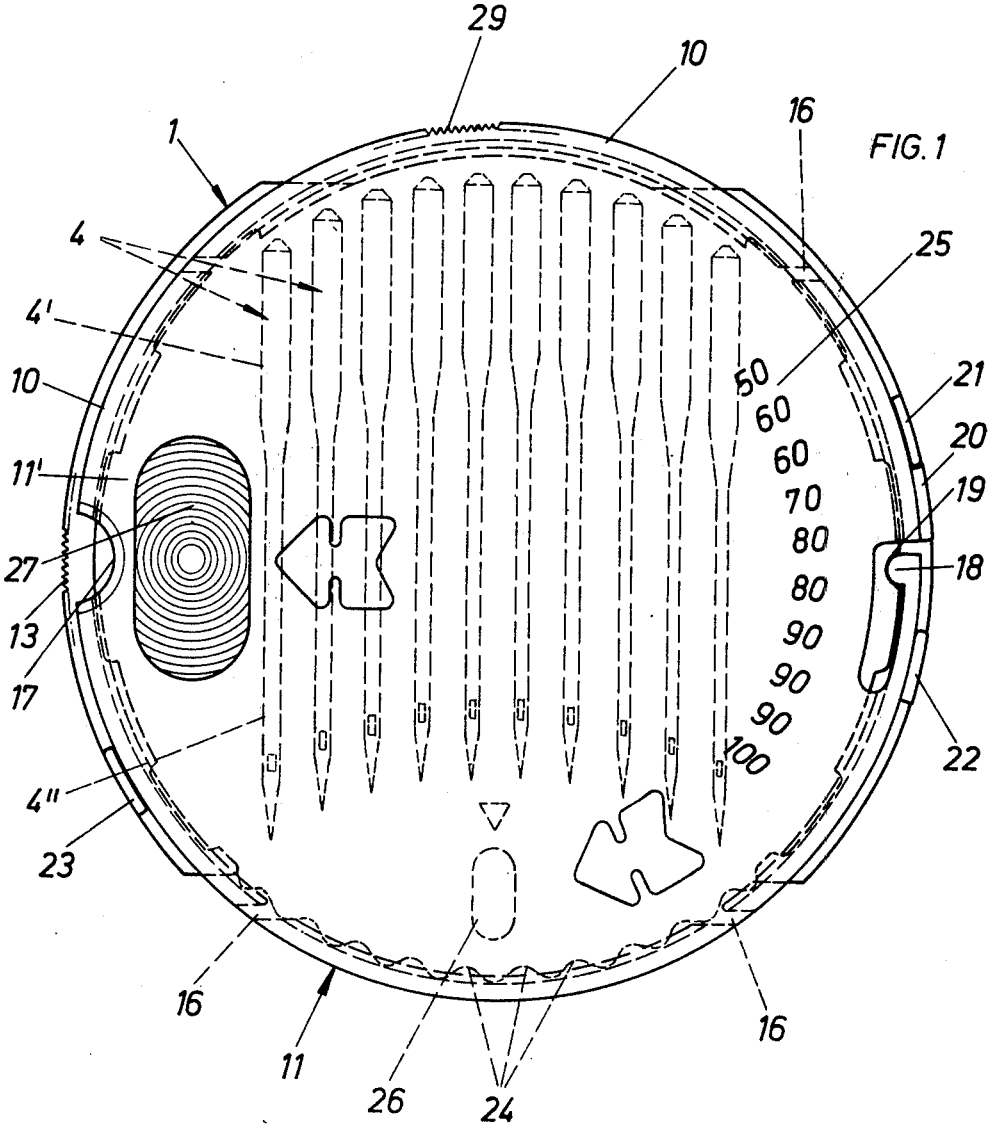
FIG. 1 is an enlarged illustration in plan view of a dispenser containing the sewing machine needles.

The edge collar or hoop 10 of the upper part 11 extends or grips over guide sections 15 of the circumferential edge 3 of the lower part 1, the guide sections 15 projecting with an annular rib 14 of the edge collar 10, whereby on the one hand the position of the upper part 11 is secured with respect to the lower part 1 and on the other hand the mounting of the upper part 11 is brought about. In order to be able to coordinate the upper part 11 to the lower part 1 facilitated in the clipping operation, the edge collar 10 of the upper part 1 is interrupted by uniformly distributed cuts 16. The edge collar 10 of the upper part 11 closes the push-in cross-sections of the reception shafts 2. At one point the edge collar 10 is equipped with a removal opening 17, which by rotation of the upper part 11 can be brought into a flush aligned position to a push-in cross-section of the reception shaft 2. In the end rotation position of the upper part constituting the closing position, the removal opening 17 lies sidewise to the reception shafts 2, note FIG. 2. Opposite to the removal opening 17 there extends a catch tooth 18 of the edge collar 10 of the upper part 11, which catch tooth 18 is formed as a freely cut section thereof. In the closing position, the catch tooth 18 steps into a notch 19 of the circumferential edge 3 of the lower part 1. This rotation end position is secured by means of a radial wing 20 extending from the edge collar 10, which wing 20 pushes abuttingly against an abutment shoulder 21 of the lower part 1.

Then still a further wing 22 is provided on the upper part 11, which wing 22 cooperates with a further abutment shoulder 23 of the lower part 1. If the wing 22 engages this shoulder 23, the removal opening 17 of the edge collar 10 is aligned flush with the push-in cross-section of the outer right-hand-lying shaft 2.

The additional rotation positions of the upper part 11 are likewise secured by catches. For this, the lower part 1 in the range of a partial section of its circumferential edge 3 forms catch notches 24 disposed one after the other corresponding to the number of the reception shafts 2. The catch notches 24 are adjusted to the shape of the catch tooth 18.

The upper part 11 is made of a transparent material which is provided with a scale 25 arranged concentrically to the center point of rotation, which indicates the gauge or thickness of the sewing machine needles. A scale line 26 of the lower part 1 is coordinated to the scale 25. For significant reading the scale line 26 is formed as a light or luminous color field.

If the upper part 11, which is formed as a cover, is rotated such that a scale number coincides with the scale line 26, the catch tooth 18 engages or grips in the corresponding catch notch 24. In this position the corresponding push-in cross-section is brought into the flush or aligned position with respect to the removal opening 17 of the upper part 11, so that the corresponding needle 4 is slid out from the reception shaft, with a correspondingly held dispenser.

FIG. 3 illustrates the scale number 100 brought into congruence with respect to the scale line 26. The removal opening 17 of the edge collar 10 now extends in front of the push-in cross-section of the first reception shaft 2. By further rotation and by the thereby occuring catch locking between the upper part 11 and the lower part 1, the push-in cross-sections can be opened one after another.

The upper part section 11' which lies laterally of the outer shaft 2 has a lens or lenticularly shaped partial surface 27. In the closing position the latter extends above a break-through opening 28 of the lower part 1 so that the dispenser is also usable as a magnifying glass.

By rotation of the upper part 11, this lenticularly formed partial surface 27 also reaches the range of the piston 4' of the sewing machine needles so that also their not illustrated engravings are readably magnified.

For the purpose of ease of handling the edge collar 10 of the upper part is likewise equipped with a knurling 29.

While I have disclosed one embodiment of the present invention it is to be understood that such embodiment is given by example only and not in a limiting sense.

I claim:

1. A dispenser for sewing machine needles or the like, comprising a lower part formed as a circular disc and having reception shafts adapted to receive sewing machine needles, said reception shafts are arranged secant-like, said lower part defining front sided push-in cross-sections respectively opening into said reception shafts through which the needles are insertable and removable, an upper part rotatably mounted on said lower part, said upper part having an upper part edge closing said front sided push-in cross-sections of said reception shafts in a closed rotation position of said upper part relative to said lower part, said upper part edge defining a removal opening rotatable to a position aligned in front of said push-in cross-section of said reception shafts, respectively in open rotation positions of said upper part relative to said lower part, said upper part is formed with a section located in a direction toward the periphery of said upper part laterally relative an outermost of said reception shafts when said upper part is in the closed rotation position relative to said lower part, said upper part section is formed into a magnifying lens section, said lower part is formed with a break-through opening therethrough located in a direction toward the periphery of said lower part laterally relative the outermost reception shaft, said break-through opening is under said lens section in the closed rotation position.

2. The dispenser as set forth in claim 1, wherein said upper part includes a partial surface portion located substantially diametrically opposite to said lens section, said partial surface portion has a scale arranged thereon concentric to a center of rotation of said upper part, and said reception shafts each define an inner end spaced from the adjacent periphery of said lower part, said inner ends of said reception shafts are located along an arc substantially the same as and spaced parallel to that defined by said push-in cross-sections of said reception shafts, whereby the lengths of said reception shafts are substantially equal to each other, said lower part defines a region in front of said inner ends of said reception shafts between said arc and the adjacent periphery of said lower part, said lower part has a scale mark in said region, said scale mark is arranged cooperatively aligned relative to said scale corresponding to aligned positions of said removal opening and said push-in cross-sections, respectively, of said reception shafts.

3. The dispenser as set forth in claim 2, wherein said scale mark constitutes a luminous color field.

4. The dispenser as set forth in claim 2, wherein said lower part has a rib covering said reception shafts in a middle range thereof, said rib is integrally attached to said lower part and extends arcuately from said lens section up up to said scale, said rib is radially inwardly disposed on said lower part relative to the location of said lens section on said upper part such that upon relative rotation of said upper part and said lower part said rib is radially inwardly disposed in front of a circular path of rotation of said lens section.

5. The dispenser as set forth in claim 4, wherein said lower part has a rear surface, said rear surface of said lower part is formed with penetration openings extending therethrough in a range under said rib.

6. The dispenser as set forth in claim 1, wherein said rotatable upper part is made of a transparent material, and said lower part is made of a black colored material.

7. The dispenser as set forth in claim 1, wherein said upper part constitutes a cover and said upper and lower parts include cooperative means for catch locking the former in said open and said closed rotation positions relative to the latter.

8. The dispenser as set forth in claim 7, wherein said lower part has a circumferential edge and is formed with edge notches disposed one behind the other in a range of a partial section of said circumferential edge, said upper part is formed with a catch tooth in a range of said upper part edge, said catch tooth is cooperatively coordinated to said notches, respectively, said notches and said catch tooth constitute said cooperative catch locking means.

9. The dispenser as set forth in claim 8, wherein said upper part edge forms an edge collar engaged on said circumferential edge of said lower part, said catch tooth is formed as a free cut section of said edge collar of said upper part.

10. The dispenser as set forth in claim 9, wherein said circumferential edge of said lower part is step shaped in a range laterally of said reception shafts and forms gripping zones projecting beyond said edge collar of said upper part.

11. The dispenser as set forth in claim 1, wherein said lower part is formed with abutment means for blocking further rotation movement of said upper part.

said upper part steps against said abutment means in rotation positions thereof relative to said lower part.

12. The dispenser as set forth in claim 11, wherein said lower part has a circumferential edge and has guide sections on said circumferential edge, said upper part edge forms an edge collar engaged on said guide sections of said circumferential edge of said lower part, said upper part is formed with a catch tooth constituting a free cut section of said edge collar of said upper part, two wings radially project from said edge collar and are disposed substantially adjacent one another on opposite sides of said crotch tooth, said lower part is formed step shaped in a range laterally of said reception shafts adjacent said circumferential edge forming a lowermost surface having two abutment shoulders projecting upwardly therefrom spaced from said circumferential edge, said two abutment shoulders are substantially diametrically opposite one another on said lower part and constitute said abutment means, said edge collar of said upper part is disposed between said abutment shoulders and said circumferential edge of said lower part, said abutment shoulders are located in a path of said wings upon relative rotation of said upper part relative to said lower part, defining between said abutment shoulders a limited rotatable movement path of said wings, one of the latter abuts one of said abutment shoulers in said closed rotation position of the dispenser, the other of said wings abuts the other of said abutment shoulders with said removal opening aligned in front of another outermost of said reception shafts remote from said first mentioned outermost reception shaft in an end open rotation position of the dispenser.

13. The dispenser as set forth in claim 12, wherein said removal opening is adjacent said lens section, said catch tooth is diametrically opposite said removal opening on said upper part, said lower part is formed with a notch in said circumferential edge diametrically opposite said break-through opening, said catch tooth catch engages in said notch in the closed rotation position of said upper part relative to said lower part with said one wing abutting said one abutment shoulder.

14. The dispenser as set forth in claim 1, wherein said lower part has a step shaped offset rear surface, a needle threading tool releasably fastened on said rear surface of said lower part.

15. The dispenser as set forth in claim 14, further comprising two holding clip means for releasably holding said threading tool in clamping seated position.

16. The dispenser as set forth in claim 1, wherein said upper part edge forms an edge collar, said edge collar is formed interrupted with uniformly distributed cuts.

* * * * *